US006427886B1

(12) United States Patent
Essex

(10) Patent No.: US 6,427,886 B1
(45) Date of Patent: Aug. 6, 2002

(54) STRAPS TO CONVERT A COOLER TO BE CARRIED AS A BACKPACK

(76) Inventor: Robert E. Essex, 8830 Mariposa Dr., Indianapolis, IN (US) 46234

( * ) Notice: Subject to any disclaimer, the term of this patent is extended or adjusted under 35 U.S.C. 154(b) by 13 days.

(21) Appl. No.: 09/696,145

(22) Filed: Oct. 25, 2000

(51) Int. Cl.[7] ..... A45F 3/04

(52) U.S. Cl. ..... 224/259; 224/250; 224/651; 294/157

(58) Field of Search ..... 224/153, 627, 224/250, 259, 651; 294/149, 150, 157; 206/314; D3/216, 217

(56) References Cited

U.S. PATENT DOCUMENTS

| | | | | | |
|---|---|---|---|---|---|
| 813,216 | A | * | 2/1906 | Karibo | |
| 1,060,257 | A | * | 4/1913 | Humphrey | |
| 4,449,378 | A | | 5/1984 | Thorpe | 62/371 |
| 4,881,684 | A | * | 11/1989 | Chinman | |
| 4,972,981 | A | * | 11/1990 | Gex | 224/250 X |
| 5,148,956 | A | * | 9/1992 | Funk | 224/250 X |
| 5,462,213 | A | | 10/1995 | Watt | 224/155 |
| 5,509,279 | A | | 4/1996 | Brown et al. | 62/457 |
| D375,403 | S | | 11/1996 | Melk | D3/217 |
| 5,579,966 | A | * | 12/1996 | Krumweide et al. | 224/259 X |
| 5,595,429 | A | | 1/1997 | Kennedy | 312/235.2 |
| 5,611,457 | A | | 3/1997 | Ash, Jr. | 221/185 |
| D386,360 | S | | 11/1997 | Krug, Sr. | D7/605 |
| 5,758,513 | A | | 6/1998 | Smith | 62/457.5 |
| 5,816,395 | A | * | 10/1998 | Dougherty | 206/314 |
| D409,375 | S | | 5/1999 | Santoro et al. | D3/217 |
| D412,311 | S | | 7/1999 | Silvershein | D12/416 |
| 5,918,785 | A | * | 7/1999 | Irose | 224/259 |
| 6,052,939 | A | | 4/2000 | McClain et al. | 43/54.1 |
| 6,067,813 | A | | 5/2000 | Smith | 62/371 |

* cited by examiner

*Primary Examiner*—Gregory M. Vidovich
(74) *Attorney, Agent, or Firm*—Woodard, Emhardt, Naughton, Moriarty & McNett

(57) ABSTRACT

A strap device for manually transporting a standard substantially rectangular cooler. The device includes a first elongated strap assembly connected to a second elongated strap assembly, wherein the first and second strap assemblies are oriented substantially perpendicular to each other and are both adapted to releasably lockingly engage the cooler. A shoulder strap assembly extends from the strap device and is adapted to releasably lockingly couple the strap device to a wearer. The shoulder strap assembly preferably extends from the second strap assembly to releasably lockingly connect to the first strap assembly.

8 Claims, 7 Drawing Sheets

STRAPS TO CONVERT A COOLER TO BE CARRIED AS A BACKPACK

TECHNICAL FIELD OF THE INVENTION

The present invention relates generally to thermally insulated containers and, more particularly, to a strap system for converting a thermally insulated container into a wearable backpack for ease of transport.

BACKGROUND OF THE INVENTION

Conventional thermally insulating boxes (i.e., coolers or ice chests) are typically rectangular boxes having thermally insulating sides into which items desired to be maintained at a given temperature are placed. The interior of a conventional cooler is usually a single rectangular space into which the items desired to be maintained at temperature and the temperature maintenance media are placed together. Usually, the desired maintenance temperature inside the cooler is colder than that of the cooler's outside environment, and the preferred temperature maintenance media are ice packs and/or loose ice cubes. Coolers are most often used to maintain quantities of beverage containers, usually 12-ounce bottles and/or cans, at low temperatures.

Conventional coolers have a pair of handles positioned at either long end by which the cooler is gripped for lifting and carrying. This carrying arrangement suffers from the disadvantages of being unwieldy for lifting the cooler as well as for setting the cooler back down. A single person must carry the cooler before him as he walks, which forces him to support the weight of the cooler with his lower back. Moreover, a typical cooler fully laden with ice and beverages can be quite heavy (about 22 pounds), quickly tiring both the carrying and the gripping muscle groups of the person carrying the cooler. Further, conventional single-cavity coolers have no structures for keeping their contents evenly distributed, further complicating the carrying process. Finally, the above factors conspire to make carrying a loaded cooler an increasingly rigorous task with increasing transport distance.

There is therefore a need for a system for adapting a conventional cooler to be carried easily and efficiently by a single person. The present invention is directed towards meeting this need.

SUMMARY OF THE INVENTION

The present invention relates to a strap device for manually transporting a cooler. The strap device includes a first elongated strap assembly adapted to releasably lockingly engage the cooler, a second elongated strap assembly likewise adapted to releasably lockingly engage the cooler, and a shoulder strap assembly adapted to releasably lockingly couple the strap device to a wearer. The first and second strap assemblies preferably connectedly intersect at substantially right angles. The shoulder strap assembly preferably extends from the second strap assembly to releasably lockingly connect to the first strap assembly.

The first and second strap assemblies may each include a plurality of substantially parallel straps. The first and second strap assemblies may be interconnected with orientations substantially parallel to each other, such that they form a web.

One object of the present invention is to provide an improved method and apparatus for manually lifting and carrying a cooler. Related objects and advantages of the present invention will be apparent from the following description.

DETAILED DESCRIPTION OF THE PREFERRED EMBODIMENT

Figure 1:
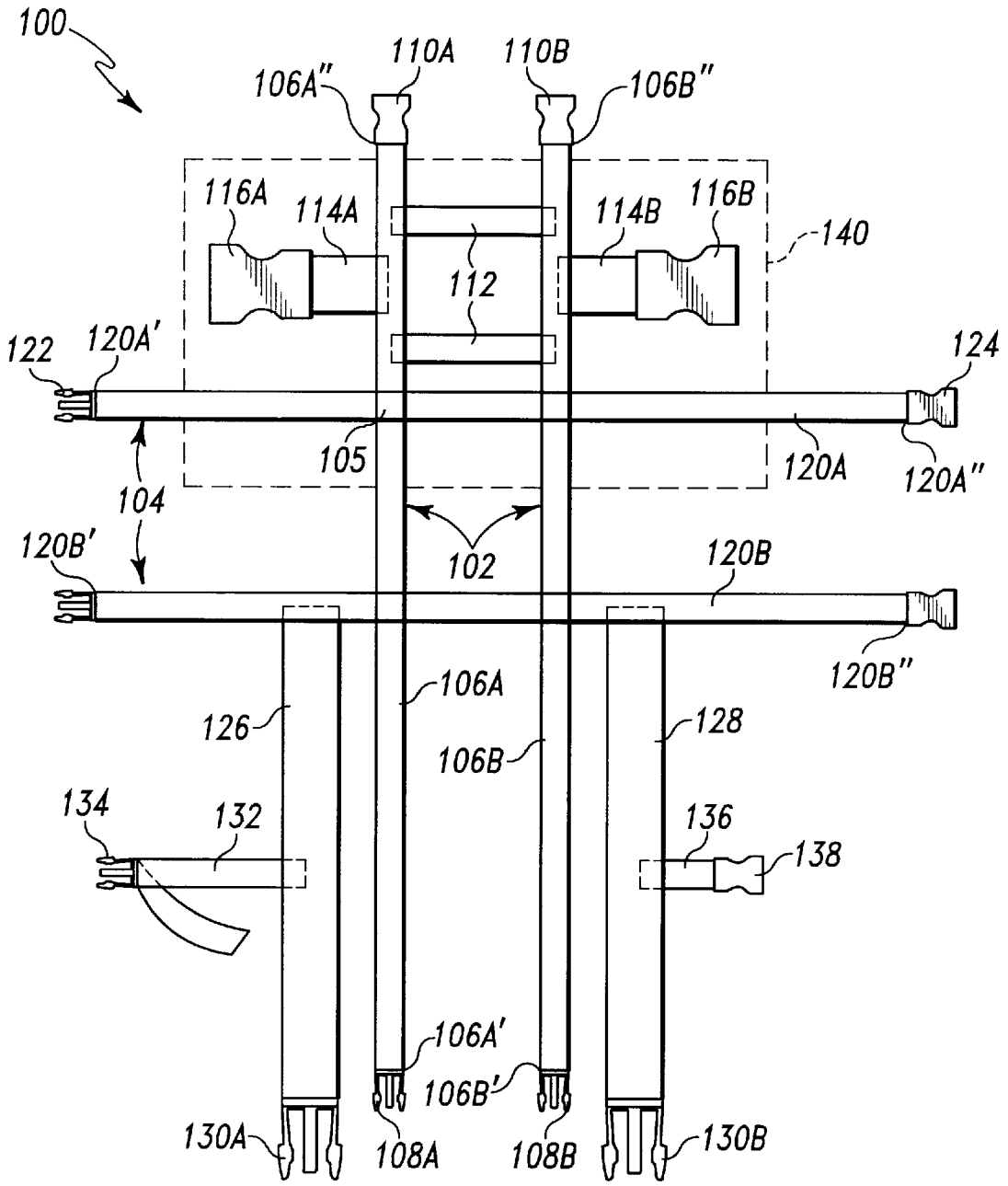
FIG. 1 is a schematic view of a first embodiment strap device of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 schematically illustrates a first embodiment of the present invention, a strap assembly 100 for enveloping a rectangular beverage cooler or the like for carrying as a backpack. The strap assembly 100 includes a first pair of elongated straps 102 and a second pair of elongated straps 104 positioned to intersect the first pair of straps 102 at a substantially right angle. Preferably, the two pairs of straps 102, 104 are fixedly attached at their overlapping intersection areas 105.

The first pair of elongated straps 102 includes a first strap 106A and a second strap 106B. The straps 106A and 106 B are positioned to extend substantially parallel to each other 106A, 106B. More preferably, the straps 106A, 106B are spaced about six inches apart, although the straps 106A, 106*b* may be spaced any convenient distance apart. Each strap 106A, 106B has a proximal end 106A', 106B' and a distal end 106A", 106B". Interlocking connectors 108, 110 are attached to the respective proximal and distal ends 106', 106". Preferably, the connectors 108, 110 are adjustably connected at or near the ends of a respective straps 106, such that the connected straps may be tightened around a cooler placed therein. The connectors 108, 110 are preferably interlocking plastic male-and-female connectors 108, 110, although any convenient connector design (such as hook and loop, interlocking snaps, buckles, or the like) may be chosen. Connectors 108, 110 are adapted to releasably lockingly engage each other to engagingly loop strap 110 around a cooler.

The straps 106A, 106B are interconnected by one, and more preferably by two, reinforcement straps 112 extending therebetween and permanently affixed to each respective elongated strap 106A, 106B. Spaced near the interconnecting reinforcement strap(s) 112 are two short wide shoulder straps 114A, 114B, each fastened to and extending a short length from a respective elongated strap 106A, 106B. The short wide shoulder straps 114A, 114B preferably extend from the respective elongated straps 106A, 106B at about 45° angles, although the intersection of the shoulder straps 114A, 114B with the elongated straps 106A, 106B may be at any convenient angle. A wide female connector 116A, 116B is connected to each respective elongated strap 106A, 106B by a respective short wide shoulder strap 114A, 114B.

The second pair of elongated straps 104 preferably includes a first and second cross strap 120A, 120B, although design options are possible including greater than two straps 120A, B or a single strap 120. Each strap 120A, B has a proximal end 1020A', 120B' and a distal end 120A", 120B". Each strap 120 further includes a male and a female connector 122, 124, attached at or near either end 120', 120" of the strap 120. Preferably, the connectors 122, 124 are of the interlocking plastic male-and female design, although any convenient connectors may be chosen. More preferably, at least one of the connectors 122, 124 is adapted to allow its position at or near the end of the strap to be adjusted, such that the effective distance between the connectors 122, 124 is a variable. In other words, it is preferably that the strap length(s) be adjustable to accommodate different cooler dimensions.

Strap 120B also preferably includes a first and a second wide shoulder strap 126, 128 extending therefrom. Connectors 130A, 130B are coupled to wide shoulder straps 126, 128, respectively. Preferably, connectors 130A, 130B are adjustably attached near the ends of the respective wide shoulder straps 126, 128 opposite strap 120B. More preferably, connectors 130A, 130B are adapted to be moved along respective wide shoulder straps 126, 128, such that the lengths of the wide shoulder straps 126, 128 are effectively independently adjustable. Connectors 130A, 130B are adapted to be releasably lockingly engaged to connectors 116A, 116B. Wide shoulder strap 126 is preferably positioned outside the interval defined between straps 106A and 106B, between strap 106A and male connector 122. Wide shoulder strap 126 is more preferably spaced about two inches from strap 106A. Wide shoulder strap 128 is preferably positioned outside the interval defined between straps 106A and 106B, between strap 106B and female connector 124. Wide shoulder strap 128 is more preferably spaced about two inches from strap 106B. Wide shoulder straps 126, 128 are preferably securely affixed to strap 120B, although embodiments of the present invention are contemplated in which wide shoulder straps 126, 128 are slidingly connected to strap 120B. Connectors 122, 124 are adapted to releasably lockingly engage one another to engagingly loop strap 122 around a cooler.

Wide shoulder strap 126 includes a first chest strap 132 attached thereto and extending therefrom. First chest strap 132 is preferably fixedly attached to wide shoulder strap 126, although it may be slidingly attached. First chest strap 132 includes a first chest strap connector 134 coupled thereto. Likewise, wide shoulder strap 128 includes a second chest strap 136 attached thereto and extending therefrom. Second chest strap 136 includes a second connector chest strap 138 coupled thereto and adapted to releasably lockingly engage first chest strap connector 134. Second chest strap 136 is likewise preferably fixedly attached to wide shoulder strap 128 and positioned such that first and second chest straps 132, 136 lockingly engage to form a chest strap extending across and substantially perpendicular to wide shoulder straps 126, 128. Alternately, second chest strap 136 may be slidingly attached to wide shoulder strap 128, if desired.

FIGS. 2A–2C, 3A–3B, and 4 illustrate in detail the process of connecting the strap system 100 to a typical box cooler. In operation, a cooler is positioned bottom-down on the strap assembly 100 as generally indicated by ghost lines 140 in FIG. 1. The first pair of elongated straps 102 is wrapped around the cooler and connectors 108A, 108B are lockingly engaged to connectors 110A, 110B, respectively (see FIGS. 2A and 2B). The elongated straps 102 may optionally be crossed, such that connectors 108A and 108B lockingly engage connectors 110B and 110A, respectively. The straps 106A, 106*b* preferably encircle the cooler, engaging the top and bottom and one pair of opposite sides of the cooler. In the case of a rectangular cooler, the straps 106A, 106B preferably engage the two longer sides, although the cooler may have any desired orientation in the strap system 100. Once the connectors 108, 110 are engaged, the straps 106A, 106B are preferably tightened around the cooler to ensure a snug fit.

Figure 2A:
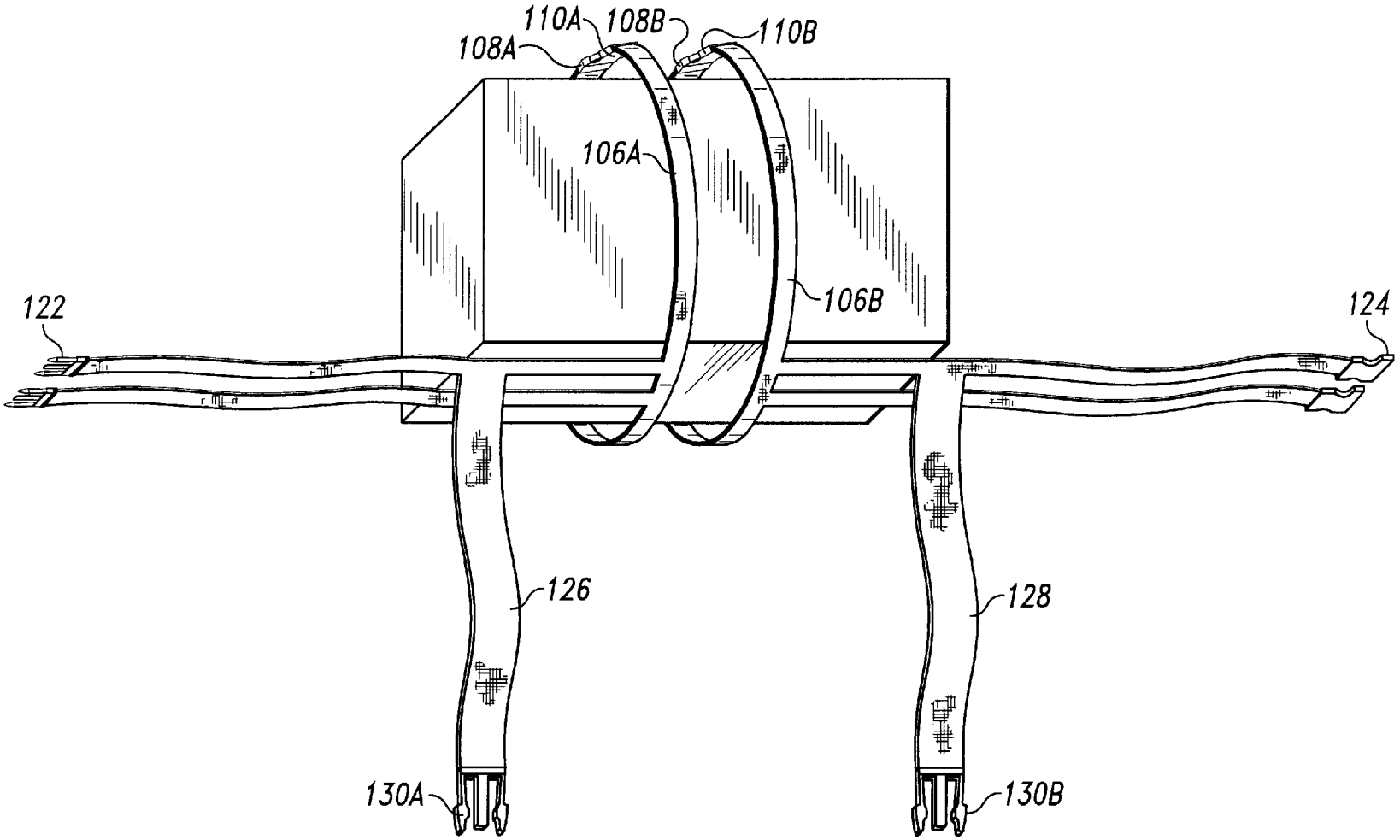
FIG. 2A is a perspective view of the embodiment of FIG. 1 partially engaging a cooler.
Figure 2B:
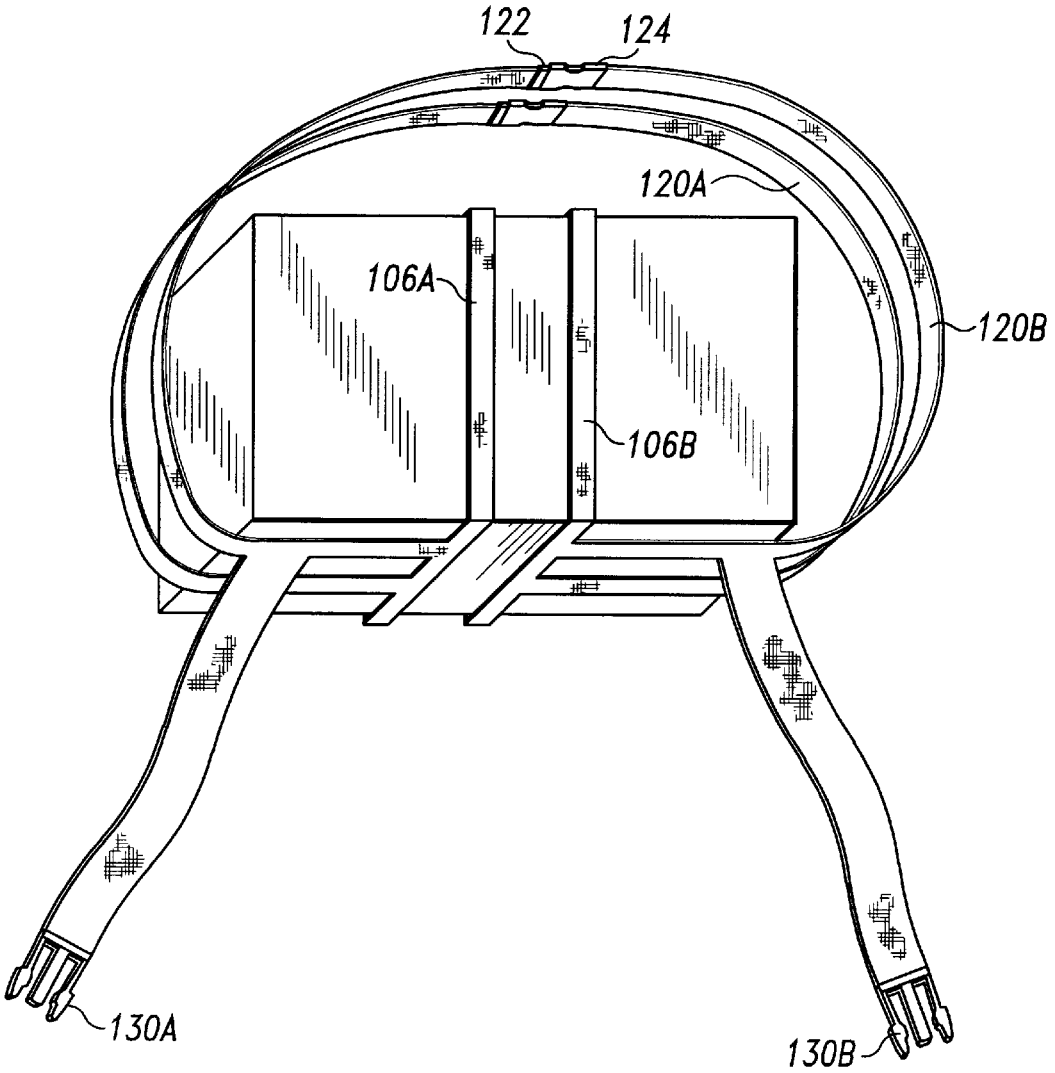
FIG. 2B is a perspective view of the embodiment of FIG. 1 further engaging a cooler.
Figure 2C:
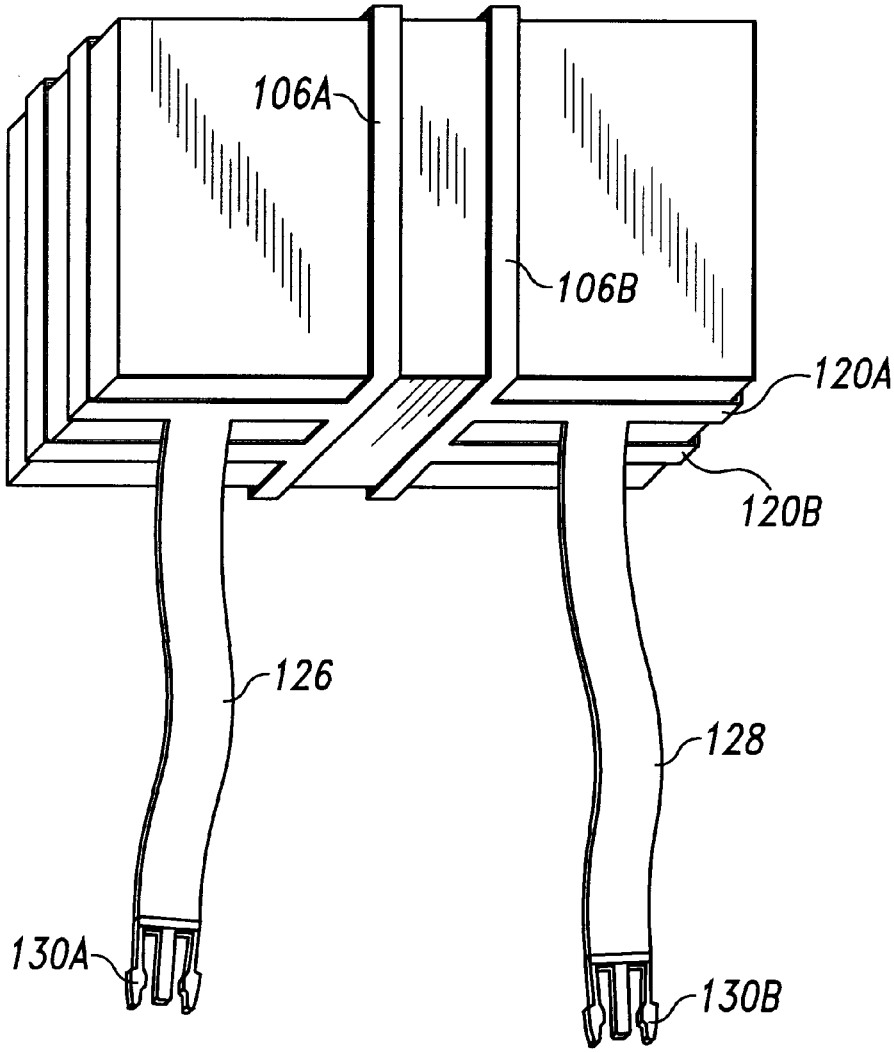
FIG. 2C is a perspective view of the embodiment of FIG. 1 engaged to a cooler.
Figure 3A:
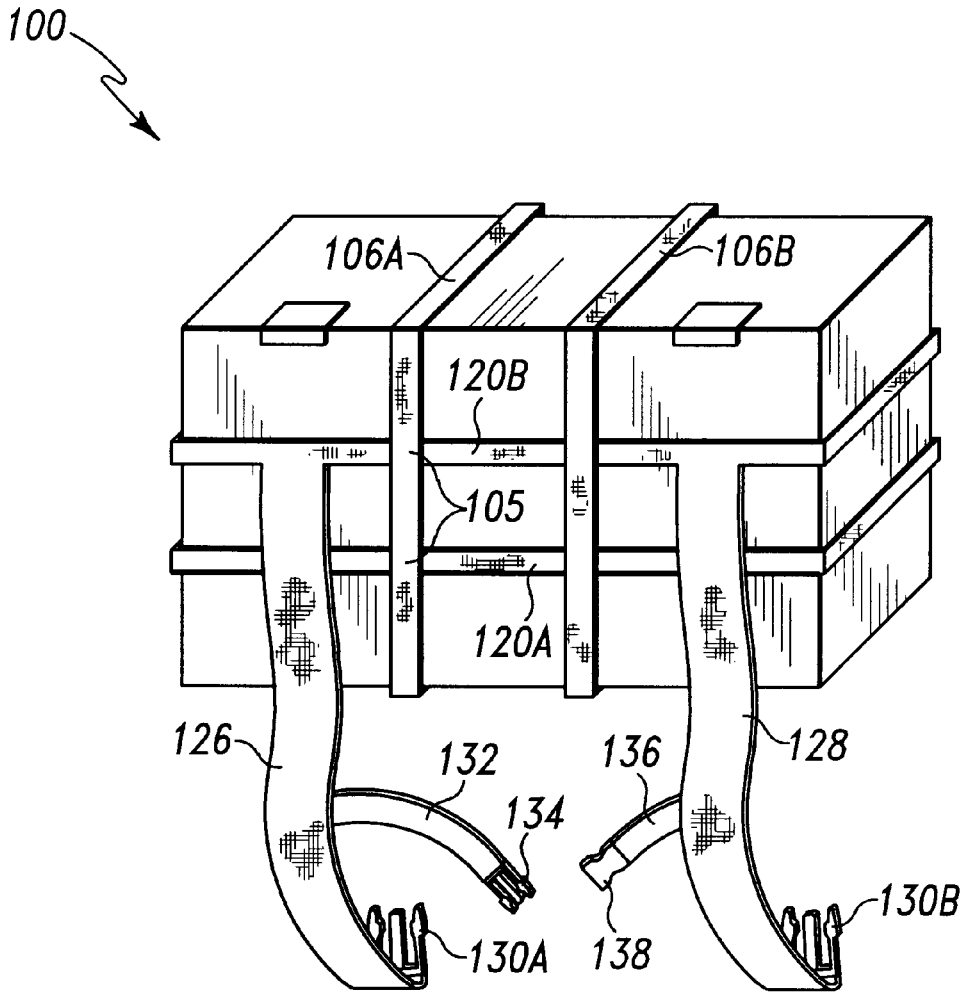
FIG. 3A is a perspective view of FIG. 2C, illustrating the preferred orientation of the cooler relative the shoulder straps in detail.
Figure 3B:
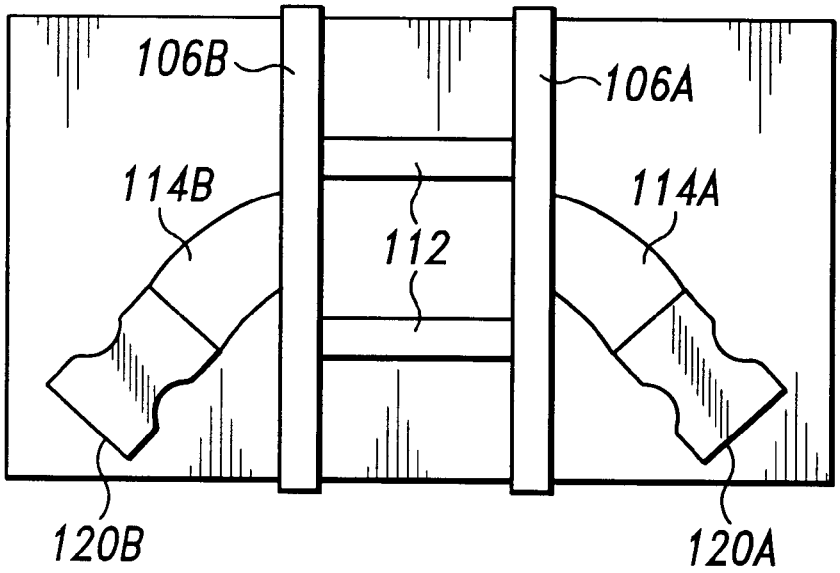
FIG. 3B is bottom plan view of FIG. 3A.
Figure 4:
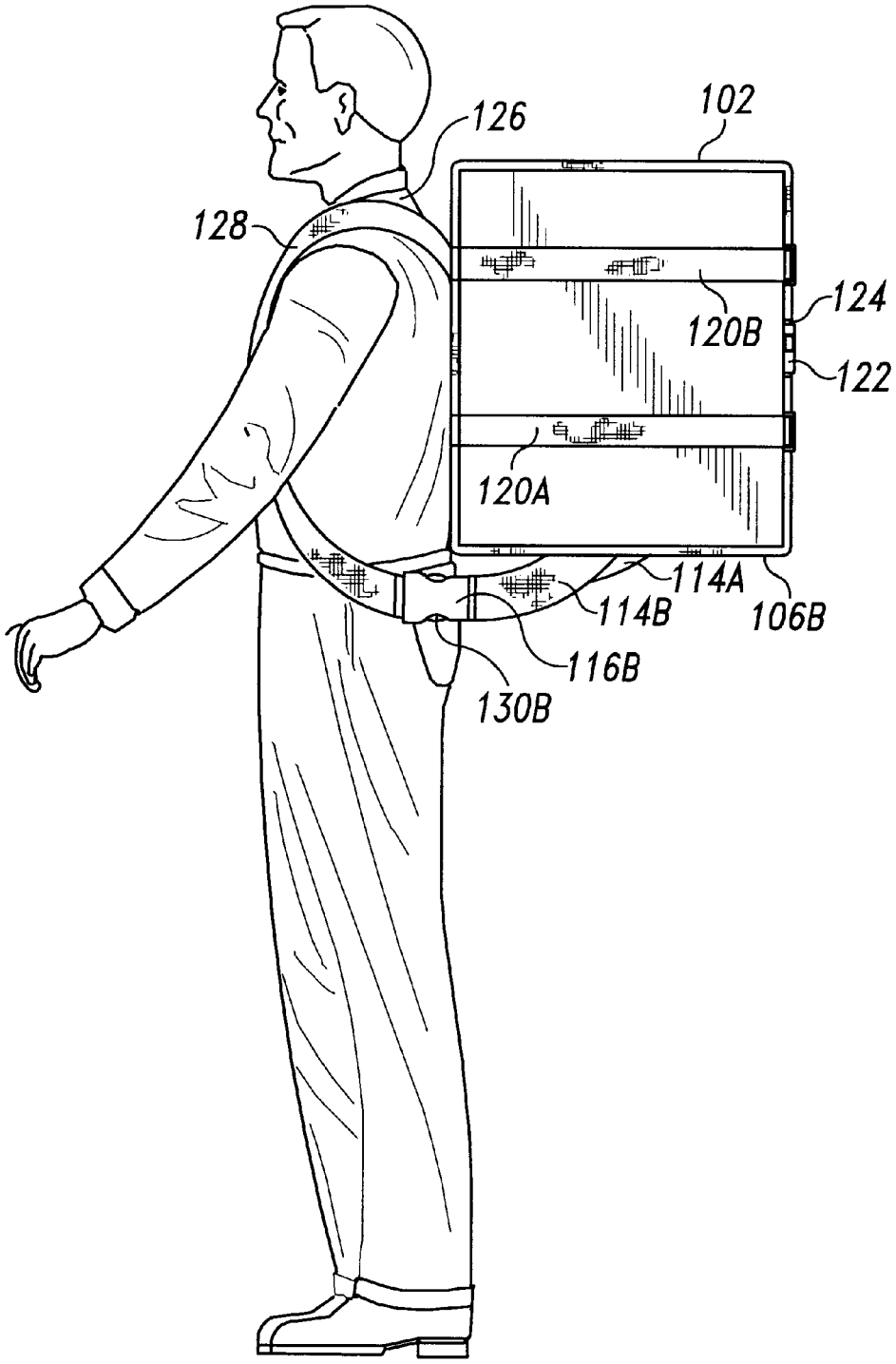
FIG. 4 is a partial perspective view of FIG. 3A engaged to a wearer.

The second pair of elongated straps 104 is then wrapped around the four sides of the cooler and connectors 122A, 122B are lockingly engaged to connectors 124A, 124B, respectively (see FIGS. 2B and 2C). Preferably, straps 120A and 120B are then tightened to ensure that the cooler is snugly held in the strap system 100.

After the strap system 100 is engaged around the cooler, the straps 106A, 106B, 120A, 120B are preferably adjusted such that the straps 106A, 106B, 120A, 120B are centered around the cooler. In other words, the straps 106A, 106B, 120A, 120B are repositioned, if necessary, such that no strap is immediately adjacent and parallel an edge of the cooler.

The cooler may now be carried by a single individual by engaging wide shoulder strap 126 over the individual's right shoulder and wide shoulder strap 128 over the individual's left shoulder. The wide shoulder straps 126, 128 are engaged by first looping a strap 126, 128 over the appropriate shoulder, down across the torso, and lockingly engaging a connector 130A, 130B into the appropriate mating connector 116A, 116B located underneath the cooler (see FIGS. 3A, 3B and 4). Once connected, wide shoulder straps 126 and 128 are preferably tightened to produce a desired fit of the cooler backpack onto the wearer's back. The fit may be tighter if the wearer desires to carry the cooler higher on his back, or looser if the wearer desires to carry the cooler lower.

The first and second chest strap portions 132, 136 may be utilized by lockingly engaging connectors 134 and 138. One or both of the chest strap portions 132, 136 may be tightened to produce a desired weight distribution of the cooler across the back and torso of the wearer.

The strap system 100 is preferably made of nylon straps, although the straps may be made of any convenient material strong and light enough to carry an ice and drink laden cooler as a backpack, such as leather or plastic. In the preferred embodiment, the straps system 100 is sewn or otherwise permanently connected together. In other embodiments, the strap system 100 may include sliding connections in which one set of straps is loopingly connected around another set.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are to be desired to be protected.

What is claimed is:

1. A strap system for carrying a cooler as a backpack, comprising:

a first elongated strap having a first strap proximal end and a first strap distal end;

a first and second releasably lockingly engagable connector, wherein the first connector is affixed to the first strap proximal end and the second connector is affixed to the first strap distal end;

a second elongated strap spaced from the first elongated strap and having a second strap proximal end and a second strap distal end;

a third and fourth releasably lockingly engagable connector, wherein the third connector is affixed to the second strap proximal end and the fourth connector is affixed to the second strap distal end;

a pair of spaced reinforcement straps extending between the first and second elongated straps, wherein the pair of spaced reinforcement straps are positioned near the distal ends of the straps;

a first short wide shoulder strap extending from the first elongated strap, wherein the first short wide shoulder strap is positioned between the pair of spaced reinforcement straps;

a first shoulder strap connector coupled to the first short wide shoulder strap;

a second short wide shoulder strap extending from the second elongated strap, wherein the second short wide shoulder strap is positioned between the pair of spaced reinforcement straps;

a second shoulder strap connector coupled to the second short wide shoulder strap;

a third elongated strap having a third strap proximal end and a third strap distal end;

a fifth and sixth releasably lockingly engagable connector, wherein the fifth connector is affixed to the third strap proximal end and the sixth connector is affixed to the third strap distal end;

a fourth elongated strap spaced from the third elongated strap and having a fourth strap proximal end and a fourth strap distal end;

a seventh and eighth releasably lockingly engagable connector, wherein the seventh connector is affixed to the fourth strap proximal end and the eighth connector is affixed to the fourth strap distal end;

a first wide shoulder strap extending from the fourth elongated strap;

a third shoulder strap connector coupled to the first wide shoulder strap and adapted to lockingly engage the first shoulder strap connector;

a second wide shoulder strap extending from the fourth elongated strap;

a fourth shoulder strap connector coupled to the second wide shoulder strap and adapted to lockingly engage the second shoulder strap connector;

a first chest strap portion extending from the first shoulder strap;

a first chest strap connector coupled to the first chest strap portion;

a second chest strap portion extending from the second shoulder strap; and a second chest strap connector coupled to the second chest strap portion and adapted to releasably lockingly engage the first chest strap connector;

wherein the first and the second straps intersect the third and the fourth straps at substantially right angles;

wherein the first wide shoulder strap extends from a position between the proximal end of the fourth elongated strap and the intersection of the fourth and first elongated straps;

wherein the second wide shoulder strap extends from a position between the distal end of the fourth elongated strap and the intersection of the fourth and second straps;

wherein the third and the fourth elongated straps connectedly intersect the first and the second elongated straps;

wherein the first and second straps are positioned substantially parallel to each other; and wherein the third and fourth straps are positioned substantially parallel to each other.

2. The strap system of claim 1 wherein the straps are nylon.

3. The strap system of claim 1, wherein the connectors are buckles.

4. The strap system of claim 1 wherein each of the elongated straps and the shoulder straps have adjustable lengths.

5. A method of manually transporting a cooler, comprising the steps of:

a) providing a cooler having a top, a bottom, a front, a back, and a first side and a second side;

b) providing a strap assembly including: a first set of straps, each first set strap having first set releasably lockingly engagable connectors coupled thereto at opposite ends; a second set of straps substantially perpendicularly connected to the first set of straps, each second set strap having second set releasably lockingly engagable connectors coupled thereto at opposite ends; and a set of shoulder straps extending from one strap of the second set of straps and releasably connectable to the first set of straps;

c) wrapping the first set of straps around the top, the front, the bottom and the back of the cooler;

d) releasably lockingly engaging the first set connectors;

e) wrapping the second set of straps around the front, the first side, the back, and the second side of the cooler;

f) releasably lockingly engaging the second set connectors;

g) positioning the shoulder straps over the shoulders of the a wearer;

and h) releasably lockingly engaging the shoulder straps to the first set of straps.

6. The method of claim 5 further comprising the steps of:

i) adjusting the first and second sets of straps toward the centers of the respective top, bottom, front, back, first side and second side;

j) tightening the first and second sets of straps; and k) adjusting the lengths of the shoulder straps.

7. The method of claim 6 wherein the first set of straps further comprises at least two elongated straps and a chest strap having an adjustable length and adapted to connectably extend between the at least two elongated straps.

8. The method of claim 6 further comprising the steps of:

l) connectably extending the chest strap between the at least two elongated straps; and m) adjusting the length of the chest strap.

* * * * *